US006161390A

United States Patent [19]

Kim

[11] Patent Number: 6,161,390

[45] Date of Patent: Dec. 19, 2000

[54] ICE MAKER ASSEMBLY IN REFRIGERATOR AND METHOD FOR CONTROLLING THE SAME

[75] Inventor: Il Shin Kim, Kyungsangnam-do, Rep. of Korea

[73] Assignee: LG Electronics Inc., Seoul, Rep. of Korea

[21] Appl. No.: 09/392,449

[22] Filed: Sep. 9, 1999

[30] Foreign Application Priority Data

Nov. 28, 1998 [KR] Rep. of Korea ..... 98-51556

[51] Int. Cl.[7] ..... F25C 5/06

[52] U.S. Cl. ..... 62/72; 62/66; 62/353

[58] Field of Search ..... 62/72, 353, 66

[56] References Cited

U.S. PATENT DOCUMENTS 3,383,876 5/1968 Frohbieter ..... 62/72

5,768,900 6/1998 Lee ..... 62/353

*Primary Examiner*—William E. Tapolcai
*Assistant Examiner*—Mohammad M Ali
*Attorney, Agent, or Firm*—Fleshner & Kim, LLP

[57] ABSTRACT

Ice maker assembly in a refrigerator and method for controlling the same, which can make a stable ice checkup step, the ice maker assembly including a driving means for generating a rotating force, an ice tray connected to the driving means for being rotated by the rotating force from the driving means to transfer ice to an underlying ice container, an ice checkup lever connected to the driving means for conducting an ice checkup step in which an amount of ice in the ice container is detected, and movement transmission means for transmission of a rotating force of the ice tray to the ice checkup lever, wherein, when the ice checkup lever starts the ice checkup step, the ice tray is rotated by a preset angle at first, to transmit a rotating force of the ice tray generated by the rotation to the ice checkup lever, which is a movement transfer means, so that the ice checkup lever makes an initial movement by a preset angle.

4 Claims, 5 Drawing Sheets

ICE MAKER ASSEMBLY IN REFRIGERATOR AND METHOD FOR CONTROLLING THE SAME

BACKGROUND OF THE INVENTION

1. Field of the Invention

The present invention relates to an ice maker assembly in a refrigerator and a method for controlling the same, and more particularly, to an ice maker assembly in a refrigerator and a method for controlling the same, which allows an accurate detection of an amount of ice kept in an ice container.

2. Background of the Related Art

As sizes of refrigerators become larger, there are refrigerators, not only with large sized refrigerating chamber and freezing chamber, but also with composite functions with various convenient devices, such as an ice maker, dispenser, in the market.

FIG. 1 illustrates a perspective view of the refrigerator with such composite functions, referring to which a related art refrigerator with composite functions will be explained. The refrigerator is provided with a freezing chamber 1 and a refrigerating chamber 2, and there is a dispenser 4 provided in a door of the freezing chamber 1 such that a user can use water or ice selectively without opening the door.

Paths for supplying water or ice to the dispenser 4 will be explained. A faucet 6 outside of the refrigerator is connected to a water supply valve 7 in the refrigerator through a pipe line 3, with a water filter 5 between the faucet 6 and the water supply valve 7. Outlet of the water supply valve 7 is branched; one connected to an ice maker assembly 20 in the freezing chamber 1 through a pipe line 13 for making ice and the other connected to a water tank 9 through another pipe line 11. The ice maker assembly 20 and the water tank 9 are connected to the dispenser 4 for supplying ice and water, respectively. Thus, the user is allowed to use ice or water at the dispenser 4.

FIGS. 2 and 3 respectively illustrate a disassembled perspective view and a front view of a related art ice maker assembly, referring to which the related art ice maker assembly will be explained.

An ice tray 24, which is supplied of water and produces ice, has a shaft 24*a* fixed to one side thereof and supported on a bracket 21, and a shaft 22*a* fixed both to the other side thereof and a driving means 22 with a built-in motor. Thus, the ice tray 24 is rotated as the driving means 22 is driven. And, there is an ice container 30 under the ice tray 24 for keeping the ice made in the ice tray 24. In the meantime, there is an ice checkup lever 26 coupled to another shaft 22*b* formed at one side of the driving means 22 such that the checkup lever 26 is rotated in a required distance in up and down directions for detecting an amount of the ice in the ice container 30.

The operation of the related art ice maker assembly will be explained with reference to FIGS. 1~3. The steps of operation of the ice maker assembly 20 have a water supply step for supplying water to the ice maker assembly 24, a freezing step for freezing water supplied to the ice tray 24, an ice checkup step for sensing an amount of ice in the ice container 30, and an ice transferring step for transferring ice from the ice tray 24 to the ice container 30, which will be explained in detail.

Water flows from the faucet 6 outside of the refrigerator to the ice tray 24 through the filter 5, the valve 7 and the pipeline 13. Upon completion of the water supply step, the ice making step is proceeded for a time period to turn the water supplied to the ice tray 24 into ice. Upon completion of the ice making step, the ice transfer step is proceeded.

However, if there is full of ice in the ice container, since no more ice transfer is required, the ice checkup step is proceeded before the ice transfer step, in which an amount of ice in the ice container 30 is sensed. In the ice checkup step, the ice checkup lever 26 is rotated downwardly by a driving force of the motor in the driving means 22. That is, as an extent of rotation of the ice checkup lever 26 is varied with the amount of ice in the ice container 30, the amount of ice in the ice container 30 can be detected by using the extent of rotation. If it is determined that the ice container 30 has a room for storing more ice in the ice checkup step, the ice tray 24 is rotated by the driving means 22, to empty the ice in the ice tray 24 into the ice container 30. Opposite to this, if it is determined that the ice container 30 is full of ice, the ice tray 24 is not rotated, not proceeding the ice transfer step. In such a case, the ice checkup step is conducted again after a preset time period, to detect the amount of ice in the ice container 30, to repeat the aforementioned process according to the result. Upon completion of the ice transfer step, water is supplied to the ice tray 24 again, repeating the aforementioned steps again.

However, the related art ice maker assembly in a refrigerator and the related art method for controlling the same have the following problems.

Once a coupling part of the ice checkup lever 26 and the driving means 22 is frozen, the ice checkup lever 26 becomes not operative properly. For example, if the ice is not used for a prolonged time period at the dispenser 4, the coupling part of the ice checkup lever 26 and the driving means 22 may be frozen, which leads to an improper operation of the ice checkup lever 26, impeding an accurate checkup of ice. As no accurate amount of ice in the ice container 30 is detected, the ice transfer step is proceeded even if there is full of ice in the ice container 30, overflowing the transferred ice from the ice container 30 and dropping down to the freezing chamber.

The inaccuracy in the ice checkup step, not only results in inconvenience in use of the refrigerator, but also deteriorates a reliability of the product.

SUMMARY OF THE INVENTION

Accordingly, the present invention is directed to an ice maker assembly in a refrigerator and a method for controlling the same that substantially obviates one or more of the problems due to limitations and disadvantages of the related art.

An object of the present invention is to provide an ice maker assembly in a refrigerator and a method for controlling the same, which can make an accurate detection of an amount of ice in an ice container.

Other object of the present invention is to provide an ice maker assembly in a refrigerator and a method for controlling the same, which can provides an accurate ice checkup step.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the ice maker assembly in a refrigerator includes driving means for generating a rotating force, an ice tray connected to the driving means for being rotated by the rotating force from the driving means to transfer ice to an underlying ice container, an ice checkup lever connected to the driving means for conducting an ice checkup step in which an amount of ice in the ice container is detected, and movement transmission means for transmission of a rotating force of the ice tray to the ice checkup lever, wherein, when the ice checkup lever starts the ice checkup step, the ice tray is rotated by a preset angle at first, to transmit a rotating force of the ice tray generated by the rotation to the ice checkup lever, which is a movement transfer means, so that the ice checkup lever makes an initial movement by a preset angle.

The movement transfer means includes a toe at one side of the ice tray, and a toe catch at one side of the ice checkup lever for receiving the rotating force generated by the rotation of the ice tray.

In other aspect of the present invention, there is provided a method for controlling an ice maker assembly, including a freezing step for freezing water in an ice tray, an ice checkup step for sensing an amount of ice in an ice container by means of an ice checkup lever, and an ice transferring step for transferring ice from the ice tray to the ice container if it is determined that the ice container is not full of ice, wherein the ice transferring step includes a first step for the ice tray to make an initial rotation by a preset angle at first, to transmit a rotating force of the ice tray generated by the rotation to the ice checkup lever, for the ice checkup lever to make an initial movement by a preset angle, and a second step for the ice checkup lever to make a further rotation, for detecting an amount of ice in the ice container.

The present invention facilitates removal of freeze of the ice checkup lever by the rotating force of the ice tray, thereby allowing the ice checkup lever to make an accurate detection of an amount of ice in the ice container.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention:

In the drawings:

FIG. 4 illustrates a disassembled perspective view of an ice maker assembly in a refrigerator in accordance with a preferred embodiment of the present invention; and, FIGS. 5~7 illustrate side views for explaining the operation of an ice maker assembly in a refrigerator shown in FIG. 4, wherein

DETAILED DESCRIPTION OF THE PREFERRED EMBODIMENT

Figure 1:
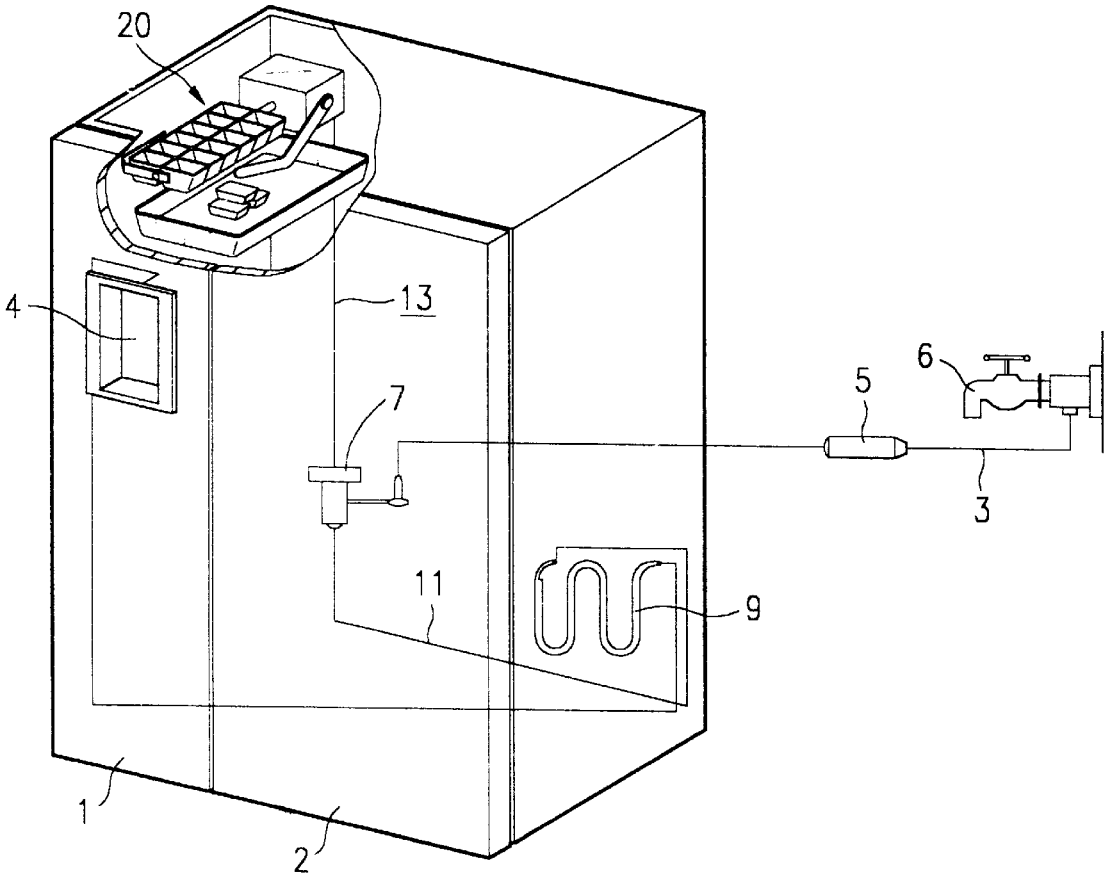
FIG. 1 Related Art
FIG. 1 illustrates a perspective view of a related art refrigerator, with a partial cut-away view, schematically.
Figure 2:
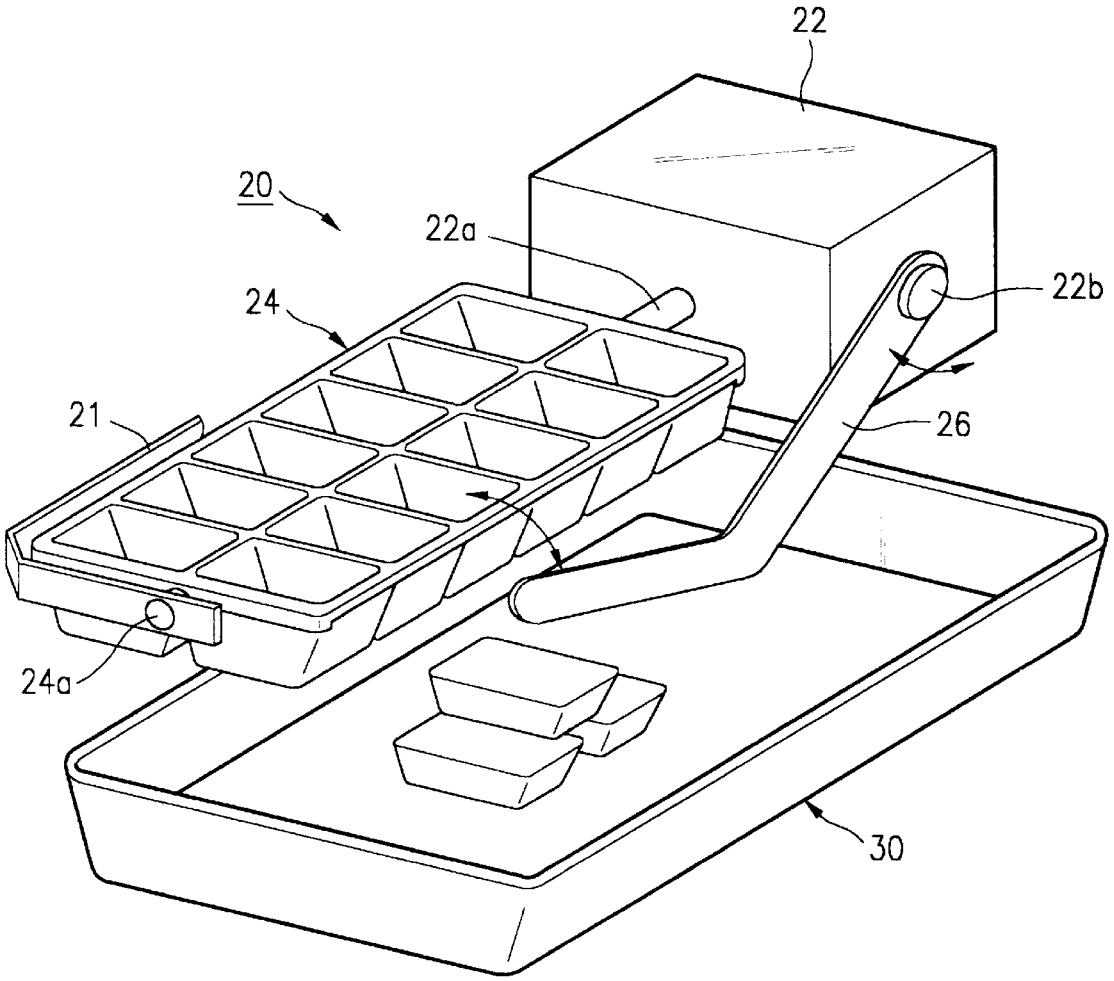
FIG. 2 Related Art
FIGS. 2 and 3 respectively illustrate a disassembled perspective view and a front view of a related art ice maker assembly in a refrigerator.
Figure 3:
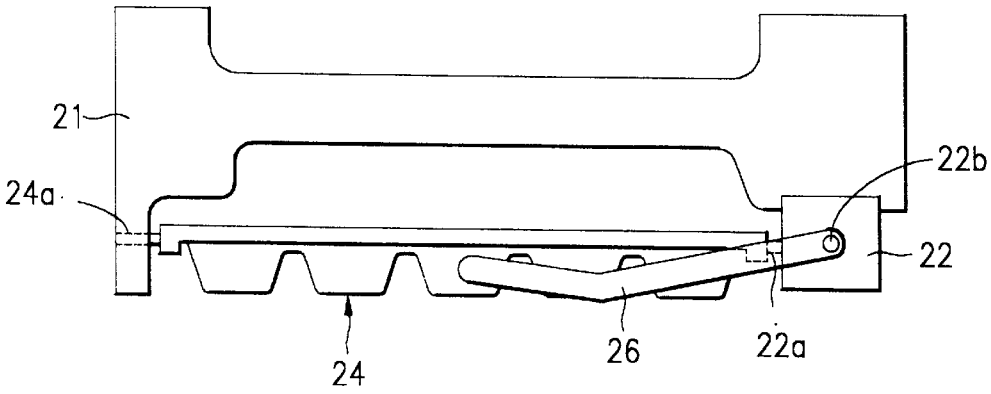
FIG. 3 Related Art
Figure 4:
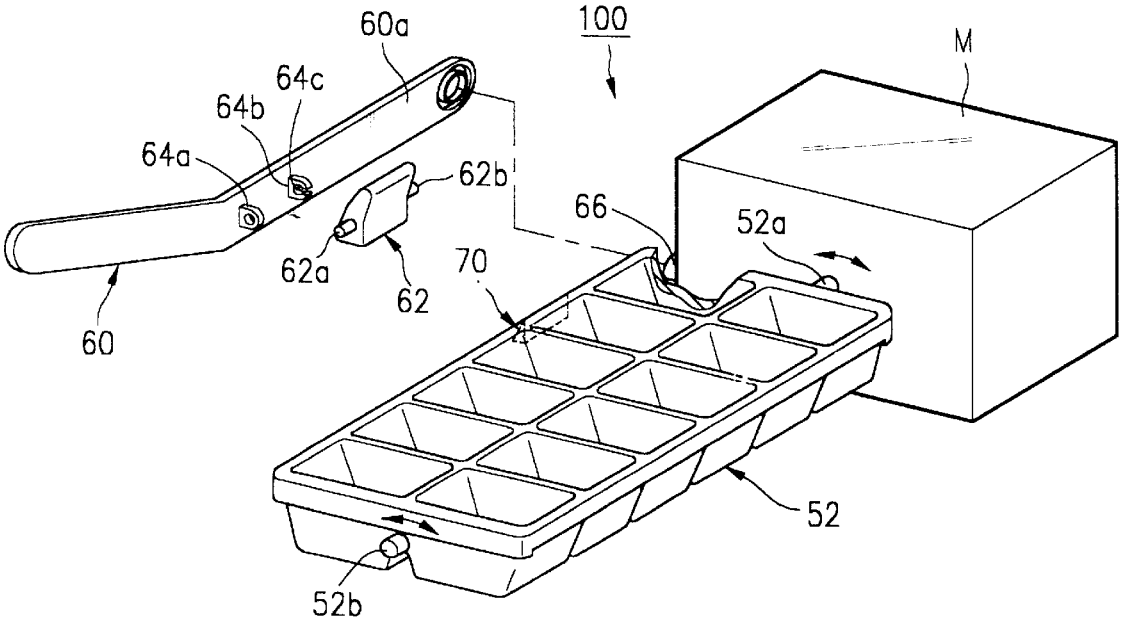
Figure 5:
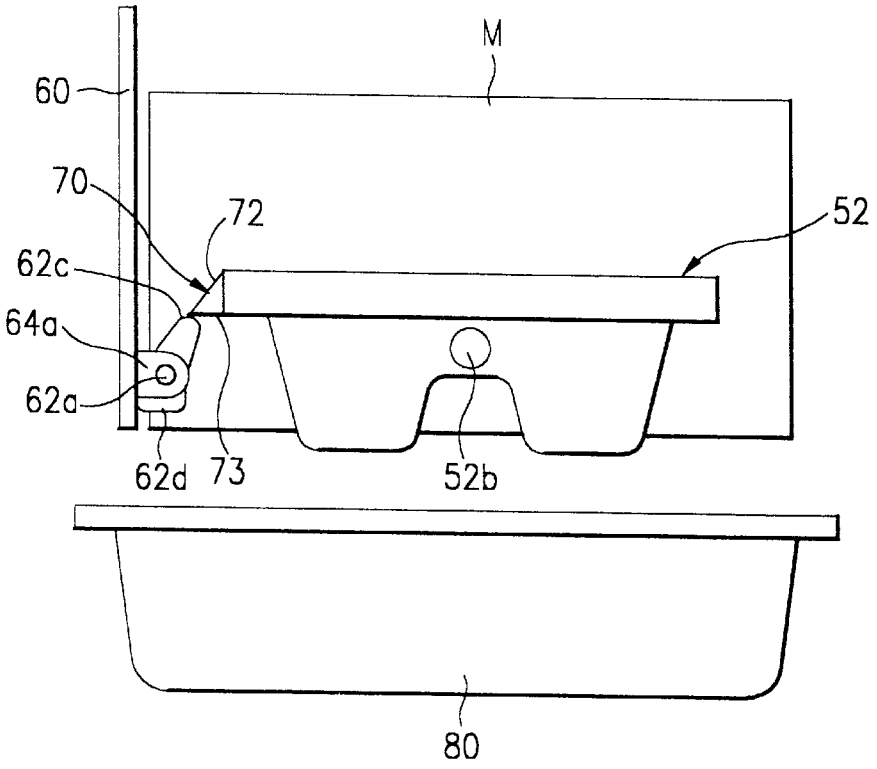
FIG. 5 illustrates a state of the ice maker assembly in ice making.

Reference will now be made in detail to the preferred embodiments of the present invention, examples of which are illustrated in the accompanying drawings. FIGS. 4 and 5 respectively illustrate a disassembled perspective view and a side view of an ice maker assembly in accordance with a preferred embodiment of the present invention, referring to which the ice maker assembly of the present invention will be explained. Components identical to the related art will be given identical names, and explanation of which will be omitted.

Alike the related art ice maker assembly, the ice maker assembly 100 in a refrigerator in accordance with a preferred embodiment of the present invention has an ice tray 52, driving means M, an ice container 80, and an ice checkup lever 60. Of course, the ice tray 52 has a supporting shaft 52*b* fixed at one side thereof supported on a bracket (not shown) and a rotating shaft 52*a* of a driving means M with a built in motor connected thereto at the other side thereof. And, an ice checkup lever 60 is also coupled to a supporting shaft 66 provided at one side of the driving means M. However, the ice maker assembly 100 of the present invention further includes a movement transmission means for rotating the ice tray 52 by a preset angle in an ice checkup step, to transmit a rotating force of the ice tray 52 generated in this rotation to the ice checkup lever 60, for making an initial movement of the ice checkup lever 60 by a preset angle.

The movement transmission means will be explained.

There is a toe 70 fixed to one side (on the ice checkup lever side) of the ice tray 52 and a toe catch 62 rotatably fitted to an inside of the ice checkup lever 60 at a position opposite to the toe 70. The toe 70 on the ice tray 52 is brought into contact with the toe catch 62 when the ice tray 52 is rotated, to make an initial movement of the ice checkup lever 60 downwardly by a preset angle. Therefore, the toe 70 is fitted such that a far end of the toe 70 is extended beyond a rim of the ice tray 52 to a position at which the far end substantially meets with a rotation radius of the toe catch 62. The toe 70 preferably has a downward sloped side 72 and a flat bottom 73. The toe catch 62 preferably has a top portion 62*c* with a smaller width and a bottom portion 62*d* with a greater width, because it is preferable that the ice checkup lever 60 is rotated by a preset angle to break a frozen state on reception of a rotating force of the toe 70 when the ice tray 52 is rotated downwardly (counter clockwise direction on the drawing) and the ice checkup lever 60 receives no rotating force of the ice tray 52 when the ice tray 52 is rotated upwardly (clockwise direction on the drawing) to an original position.

The following structure is provided for fitting the toe catch 62 to the ice checkup lever 60. There are one pair of holders 64*a* and 64*b* on the inside of the ice checkup lever 60 for holding the toe catch 62. Each of the holders 64*a* and 64*b* has a hole 64*c*. The toe catch 62 has a shaft 62*a* and 62*b* at opposite sides thereof for insertion to the holes 64*c*. Thus, the toe catch 62 can be rotatably held by the holders 64*a* and 64*b*. As shown in FIG. 4, preferably the hole of one of the holders 64*a* and 64*b* is opened for easy assembly of the toe catch 62.

Figure 6:
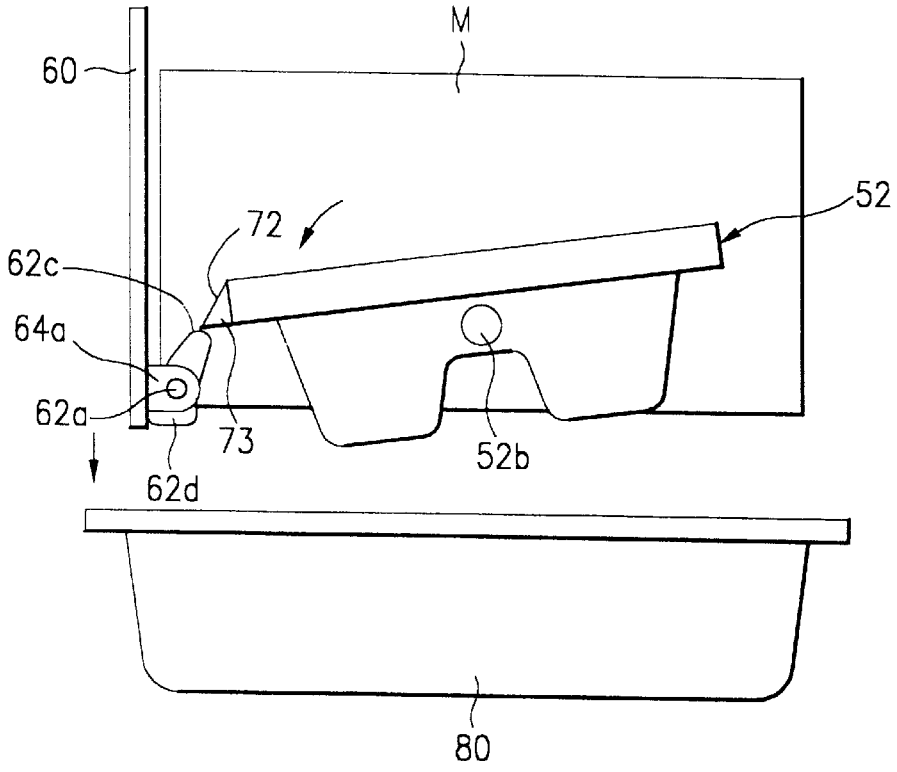
FIG. 6 illustrates a state of the ice maker assembly in ice checkup step.
Figure 7:
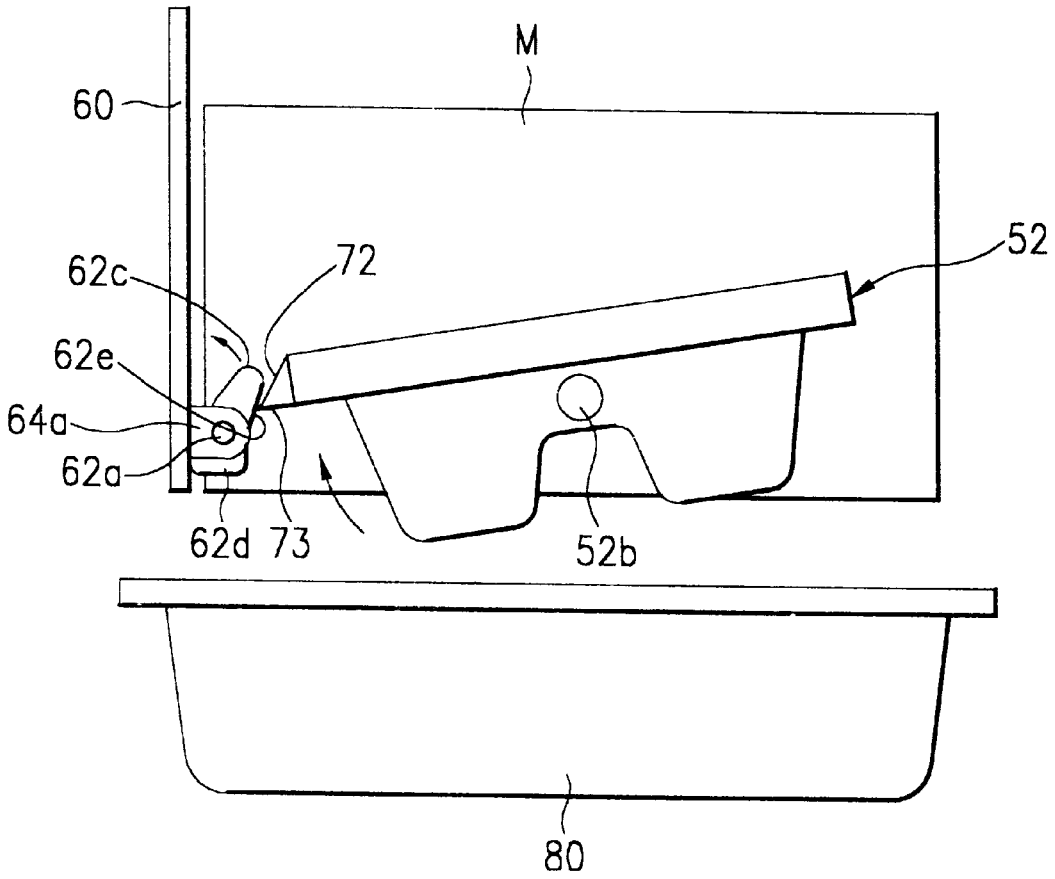
FIG. 7 illustrates a state in which an ice tray restores an original position.

The operation of the ice maker assembly of the present invention and a method for controlling the same will be explained, with reference to FIGS. 5~7.

Referring to FIG. 5, during the water supply step and the ice making step, the ice tray 52 is held horizontal, and upon completion of the ice making step, the ice checkup step and the ice transfer step are started. As shown in FIG. 6, different from the related art, the ice checkup step of the present invention starts with rotating the ice tray 52 downwardly (counter clockwise direction on the drawing) by a preset angle. In this instance, as the toe 70 on the ice tray 52 is positioned on a rotation radius of the toe catch 62, the bottom 73 of the toe 70 is brought into contact with the top portion 62*c* of the toe catch 62. Under this state, if the ice tray 52 keeps rotating further by a preset angle, for example, about 45°, a rotating force is transmitted to the toe catch 62 in contact with the toe 70. In this instance, as the bottom portion 62*d* of the toe catch 62 is brought into contact with a side of the ice checkup lever 60, the toe catch 62 rotates no more, but moves downwardly as the toe catch 62 follows the rotation of the ice checkup lever 60 by a preset angle. That is, in the present invention, even if the ice checkup lever 60 is frozen, the ice checkup lever 60 still rotates downwardly as the ice checkup lever 60 breaks the freeze. Though the freeze of the related art ice checkup lever is hard to break since the ice checkup lever is rotated only by a rotating force of the ice checkup lever, the freeze of the ice checkup lever of the present invention can be broken as the ice checkup lever 60 can be rotated with easy as a distance between the rotation shaft 66 of the ice checkup lever 60 and the toe catch 62 provides a great moment. Therefore, though it is preferable that the toe 70 and the toe catch 62 opposite to the toe 70 are positioned farther from the rotation shaft of the ice checkup lever 60 as far as possible, the toe 70 and the toe catch 62 are preferably positioned close to an end of a horizontal portion 60*a* of the ice checkup lever 60. On the other hand, the rotating force of the ice tray 52 is transmitted to the ice checkup lever 60 no more once the ice tray 52 is rotated more than a preset angle, because the ice tray 52 rotates centered on a fixed axis of the rotating shaft 52*a* while the ice checkup lever 60 moves downwardly, such that the toe catch 62 is out of a range of a rotating locus of the toe 70 on the ice tray 52, making a distance between the toe 70 and the toe catch 62. Thus, the rotation of the ice tray 52 to a required distance by the aforementioned steps breaks the freeze of the ice checkup lever 60. Then, a rotating force of the driving means M is directly applied to the ice checkup lever 60, to rotate the ice checkup lever 60 further down, to checkup the amount of ice in the ice container 80. As a result of the checkup, if it is determined that there is no ice in the ice container 80, the ice tray 52 is turned fully, to empty the ice in the ice tray 52 completely into the ice container 80, and is returned to an original position, and, if it is determined that there is full of ice in the ice container 80, the ice tray 52 is returned to the original position, directly.

The steps in which the ice tray 52 returns to an original position will be explained with reference to FIG. 7.

In order to put the ice tray 52 back to the original position, the ice tray 52 should be rotated to a direction (a clockwise direction on the drawing) opposite to a direction of rotation made in the ice transfer step. In this instance, as the toe 70 has the sloped side 72 and the toe catch 62 also has a shape corresponding to the sloped side 72, the toe 70 is, not caught by the bottom portion 62*d* of the toe catch 62, but rotated upwardly while contacting with a front surface 62*e* of the toe catch 62. Moreover, further upward rotation of the ice tray 52 causes the toe catch 62 to rotate toward the ice checkup lever 60 (a counter clockwise direction on the drawing) as the toe catch 62 has a smaller width of the top portion 62*c*, preventing interference between the toe catch 62 and the toe 70 and allowing a smooth returning of the ice tray 52 to the original position.

The ice maker assembly in a refrigerator and the method for controlling the same have the following advantages.

While the related art ice maker assembly is difficult to break the freeze between the ice checkup lever 60 and the driving means M by a rotating force of the ice checkup lever 60 itself, causing improper operation of the ice checkup lever 60, the ice maker assembly of the present invention can break the freeze between the ice checkup lever 60 and the driving means M by rotating the ice tray 52 by an angle, thereby transmitting a rotating force to the ice checkup lever 60. Accordingly, even if the ice checkup lever 60 is frozen, the present invention can remove the freeze and allows the ice checkup lever 60 to make an accurate ice checkup, allowing an accurate detection of an amount of ice in the ice container 80. As a result, the inconveniences, such as overflow of ice from the ice container 80 to the freeze chamber caused by malfunction of the ice container 52 coming from malfunction of the ice checkup lever 60, can be resolved, whereby ensuring a reliability of the refrigerator.

It will be apparent to those skilled in the art that various modifications and variations can be made in the ice maker assembly in a refrigerator and a method for controlling the same of the present invention without departing from the spirit or scope of the invention. Thus, it is intended that the present invention cover the modifications and variations of this invention provided they come within the scope of the appended claims and their equivalents.

What is claimed is:

1. An ice maker assembly in a refrigerator comprising:

driving means for generating a rotating force;

an ice tray connected to the driving means for being rotated by the rotating force from the driving means to transfer ice to an underlying ice container;

an ice checkup lever connected to the driving means for conducting an ice checkup step in which an amount of ice in the ice container is detected; and, movement transmission means for transmission of a rotating force of the ice tray to the ice checkup lever, wherein, when the ice checkup lever starts the ice checkup step, the ice tray is rotated by a preset angle at first, to transmit a rotating force of the ice tray generated by the rotation to the ice checkup lever, which is a movement transfer means, so that the ice checkup lever makes an initial movement by a preset angle.

2. The ice maker assembly as claimed in claim 1, wherein the movement transfer means includes;

a toe at one side of the ice tray, and a toe catch at one side of the ice checkup lever for receiving the rotating force generated by the rotation of the ice tray.

3. The ice maker assembly as claimed in claim 2, wherein the toe catch is rotatably fitted to one side of the ice checkup lever, and the toe is fitted such that a far end of the toe is extended beyond a rim of the ice tray to a position at which the far end substantially meets with a rotation radius of the toe catch, and has a downward sloped side, so that, when the toe is rotated downwardly together with the ice tray, the toe, caught by the toe catch, can move the ice checkup lever downwardly, and, when the toe is rotated upwardly together with the ice tray, the toe rotates the toe catch, permitting the ice tray to move upwardly without making interference with the toe catch.

4. A method for controlling an ice maker assembly, comprising a freezing step for freezing water in an ice tray, an ice checkup step for sensing an amount of ice in an ice container by means of an ice checkup lever, and an ice transferring step for transferring ice from the ice tray to the ice container if it is determined that the ice container is not full of ice, wherein the ice transferring step includes;

a first step for the ice tray to make an initial rotation by a preset angle at first, to transmit a rotating force of the ice tray generated by the rotation to the ice checkup lever, for the ice checkup lever to make an initial movement by a preset angle, and a second step for the ice checkup lever to make a further rotation, for detecting an amount of ice in the ice container.

* * * * *